US005821754A

United States Patent [19]

Puettmann et al.

[11] Patent Number: 5,821,754

[45] Date of Patent: Oct. 13, 1998

[54] IGNITION SYSTEM FOR AN INTERNAL COMBUSTION ENGINE

[75] Inventors: Lothar Puettmann, Weissach; Walter Gollin, Sachsenheim; Frank Hacklaender, Stuttgart; Juergen Foerster, Chemnitz, all of Germany

[73] Assignee: Robert Bosch GmbH, Stuttgart, Germany

[21] Appl. No.: 674,376

[22] Filed: Jul. 2, 1996

[30] Foreign Application Priority Data

Jul. 5, 1995 [DE] Germany ..... 195 24 499.0

[51] Int. Cl.[6] ..... F02P 17/00

[52] U.S. Cl. ..... 324/388; 324/380; 324/399

[58] Field of Search ..... 324/378, 380, 324/388, 393, 399

[56] References Cited

U.S. PATENT DOCUMENTS

| | | | |
|---|---|---|---|
| 4,291,383 | 9/1981 | Tedeschi et al. | 324/384 X |
| 4,918,389 | 4/1990 | Schleupen et al. | 324/399 |
| 5,027,073 | 6/1991 | Kaller et al. | 324/388 |
| 5,215,067 | 6/1993 | Shimasaki et al. | 324/399 X |
| 5,221,904 | 6/1993 | Shimasaki et al. | 324/378 |
| 5,226,394 | 7/1993 | Shimasaki et al. | 324/399 X |
| 5,237,279 | 8/1993 | Shimasaki et al. | 324/391 |
| 5,283,527 | 2/1994 | DeBiasi | 324/391 |
| 5,327,090 | 7/1994 | Shimasaki et al. | 324/378 |
| 5,446,385 | 8/1995 | Kugler et al. | 324/388 |
| 5,606,118 | 2/1997 | Muth et al. | 73/116 |

*Primary Examiner*—Glenn W. Brown
*Attorney, Agent, or Firm*—Kenyon & Kenyon

[57] ABSTRACT

An ignition system for internal combustion engines, which have means for detecting the secondary voltage transformed to the primary side of an ignition coil, the signal detected by these means being fed to an evaluation device. The evaluation device determines the damping of the voltage signal after the end of sparking, this damping representing a measure for the magnitude of the shunt resistance on the secondary side.

5 Claims, 9 Drawing Sheets

IGNITION SYSTEM FOR AN INTERNAL COMBUSTION ENGINE

BACKGROUND INFORMATION

U.S. Pat. No. 4,918,389 (corresponding to European Patent Application No. EP 0 344 349) describes an ignition system which is monitored on the basis of the primary-circuit-side monitoring of the spark duration. To this end, the spark voltage transformed to (induced in) the primary side is detected and compared, accordingly, to specifiable threshold values, so that a faulty combustion is inferred when the spark voltage deviates from these threshold values.

Other known methods for monitoring the functioning of ignition systems are, e.g., monitoring the catalyst temperature, detecting irregular running, and detecting the lambda probe signal.

SUMMARY OF THE INVENTION

The ignition system according to the present invention has the advantage that faults on the secondary side of the ignition coil, such as shunt firings at the spark plug, are detected before ignition misfiring occurs. The transient phenomena of the residual energy in the ignition coil are detected and evaluated following spark quenching. The transient phenomena of the residual energy in the ignition coil lead to oscillations on the primary and the secondary side of the ignition coil, which are damped more or less heavily by possible shunt resistance at the spark plugs. Therefore, this damping is a means for measuring existing shunt resistance in the secondary circuit. This makes it possible, for example, to get precise information about the condition of the spark plug without having to remove the spark plug itself. Overall, therefore, by analyzing these post-processes after sparking ends, the evaluation is made independently of the gas discharge conditions and, thus, of other influences. It is merely the electrical parameters of the ignition system that have an effect.

It is possible, for example, to detect the damping after sparking ends in different ways. In the final analysis, the evaluation unit for detecting the damping can be integrated in the control unit itself, thus permitting the damping to be immediately considered when the controlled variables are determined. It is possible, for example, for a heavy damping caused by shunt resistance to lead to an increase in the ignition energy and, thus, possibly to a self-cleaning of the spark plug.

DETAILED DESCRIPTION

Figure 1:
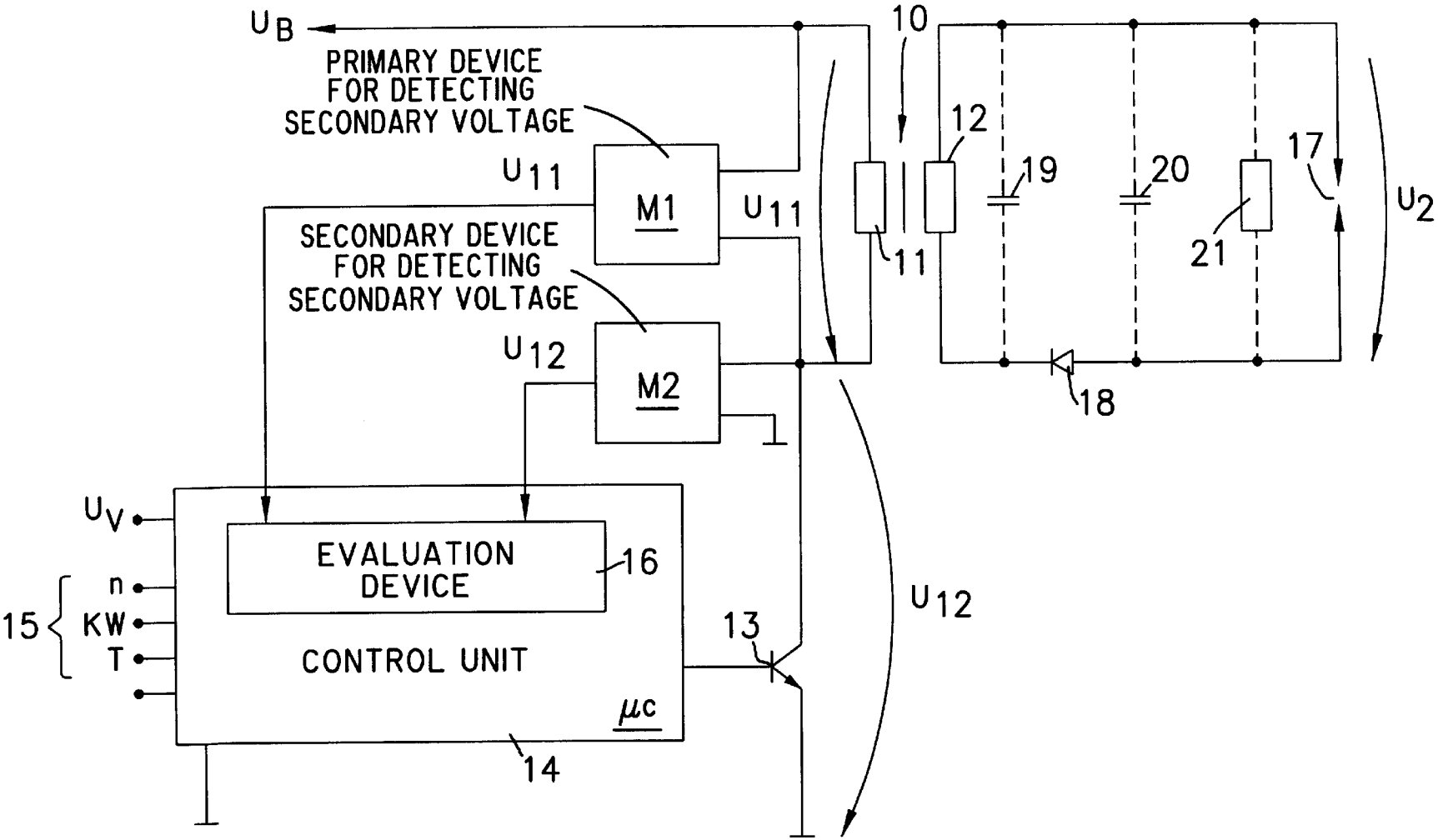
FIG. 1 shows a schematic circuit diagram of an ignition system for implementing the method according to the present invention.

FIG. 1 illustrates a schematic, basic circuit diagram of an ignition system. An ignition coil 10 is comprised in this case of a primary winding 11 and a secondary winding 12. The primary winding 11 is connected, on one side, to the supply voltage $U_B$, for example, of the battery (not shown) of an internal combustion engine. The other end of the primary winding 11 is connected via an ignition power module 13 to ground. The sensors (not shown) of an internal combustion engine detect the operating parameters such as engine speed (n), arc of crankshaft rotation (KW), and temperature (T). The recorded sensor signals are fed as input variables 15 to a control unit 14. On the basis of the recorded operating parameters and stored characteristics maps, this control unit 14 determines the various controlled variables. Thus, the dwell period and the point of ignition for the ignition system are determined and output, accordingly, as an output signal to the control input of the ignition power module 13. Furthermore, means are provided on the primary side for detecting the secondary voltage transformed to the primary side. Circuit arrangements for detecting the primary voltage are known, for example, from U.S. Pat. No. 4,918,389 and, therefore, shall not be explained in detail here.

In principle, however, it is possible to detect the secondary voltage transformed to the primary side either through the voltage drop $U_{11}$ across the primary winding 11 using the means M1 or to detect the voltage drop between the output of the primary winding and ground, thus across the power module 13 $U_{12}$ using the means M2. The output signals of these means M1, M2 for detecting the secondary voltage transformed to the primary side are fed to an evaluation device 16, which is integrated in the control unit 14 in FIG. 1. Of course, this evaluation unit 16 can also be arranged separately, it being necessary then for the output signal from this evaluation device 16 to be fed to the control unit 14. The secondary coil 12 of the ignition coil 10 is connected to a spark plug 17, so that a high enough voltage at the spark plug results in an arcing (flashover). Between one end of the secondary winding 12 of the ignition coil 10 and the spark plug 17, a diode 18 is provided for suppressing energizing sparks. This diode 18 may also be omitted. Illustrated as replacement components on the secondary side are a capacitor 19, which represents the secondary capacitance within the ignition coil, a capacitor 20, which represents the secondary capacitance outside of the ignition coil, e.g., the line capacitance of the ignition harness, and a resistor 21 for the purpose of illustrating the shunt resistance. These inductors, capacitors, and resistors, which represent an equivalent circuit diagram, form a resonant circuit, the damping of the resonant circuit depending on the size of the shunt resistor 21, since the shunt resistance is the only quantity that changes during operation of the internal combustion engine, for example because of arc erosion and contamination.

Figure 2:
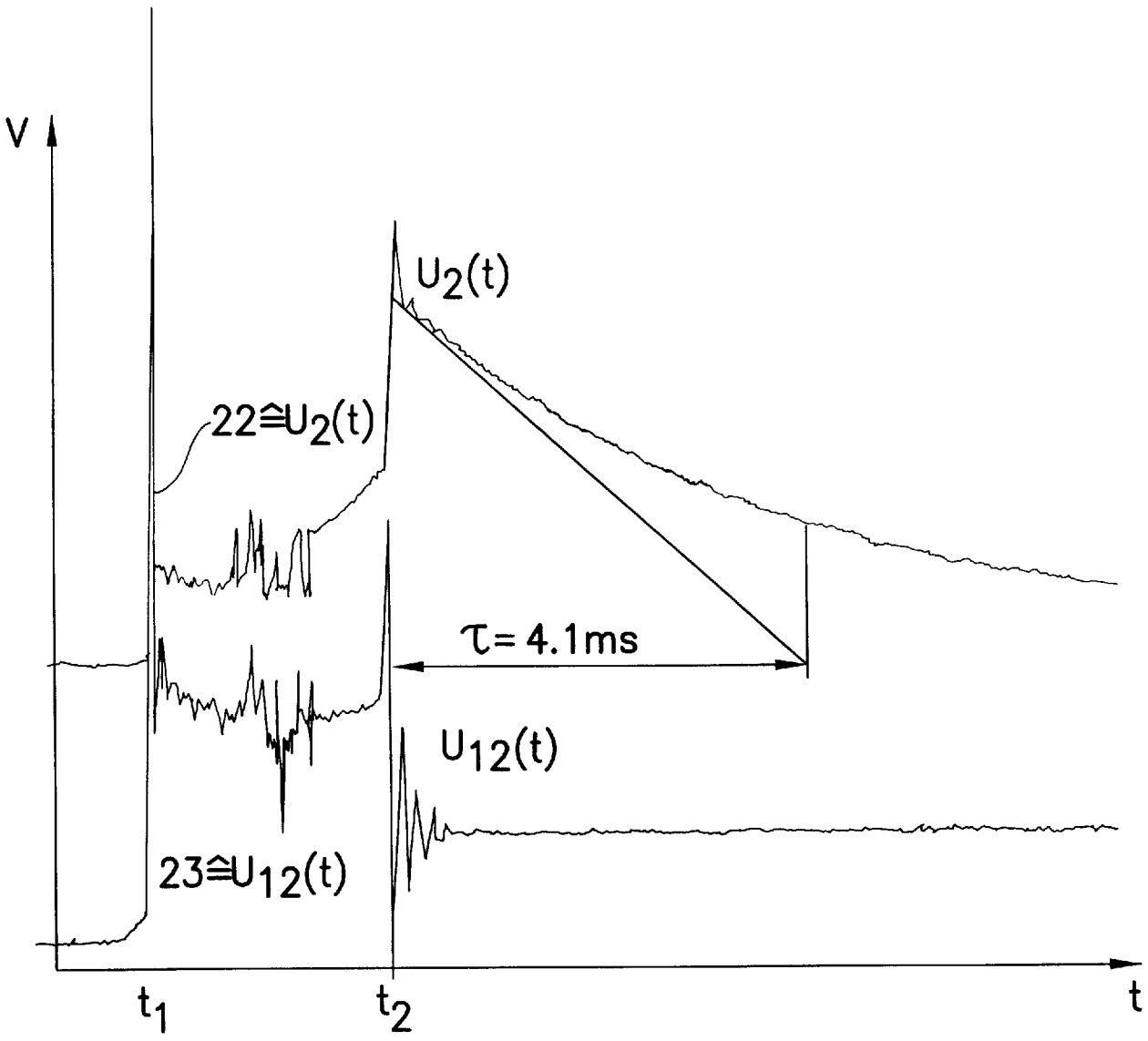
FIG. 2 illustrates the primary and secondary voltage of an ignition system having a shunt resistance of 100 MΩ.

FIG. 2 shows the primary and secondary voltage, ;as they occur in the ignition system in accordance with FIG. 1, comprising the diode 18 for suppressing energizing sparks. At an instant not illustrated here, a charging current begins to flow in the primary winding 11 of the ignition coil 10 and is interrupted at the instant $t_1$, which, for example, is the calculated point of ignition. Thus, a high voltage is induced on the secondary side and leads to the arcing at the spark plug 17 and then, in the typical illustrated spark voltage characteristic, burns out at the instant $t_2$, which represents the end of sparking. The curve 22 thereby shows the secondary-side voltage characteristic $U_{2(t)}$. The curve 23 shows the voltage characteristic transformed to the primary side, the voltage characteristic being detected by the detecting means M2 and fed to an evaluation device 16. In the circuit arrangement according to FIG. 1 comprising the energizing-spark suppression diode 18, the secondary circuit is isolated by the installed diode when the secondary voltage drops. The remaining secondary capacitor 20 can only be discharged by the ion current, which should be disregarded, and by the current through the shunt resistor 21. A typical time constant amounts to $\tau$=4.1 ms. The curve 23 shows the secondary voltage transformed to the primary side and, thus, also the characteristics of the residual resonant circuit. The voltage characteristics in FIG. 2 are the expected ideal form for the case that the shunt resistance $R_N$ is negligibly small.

At this point, if the shunt resistance changes at the spark plug 17, then the oscillatory and damping characteristics of the secondary circuit also change. Thus, an evaluation of the oscillatory characteristics after the end of sparking, therefore after the instant t2, can give information about the status of the secondary circuit. A possible shunt resistance can be countered, for example, by raising the ignition voltage in the subsequent ignition cycle, so that an ignition misfiring cannot occur in the first place. As a result, one is able to influence the functioning of the ignition system very quickly by evaluating the electrical properties.

Figure 3A:
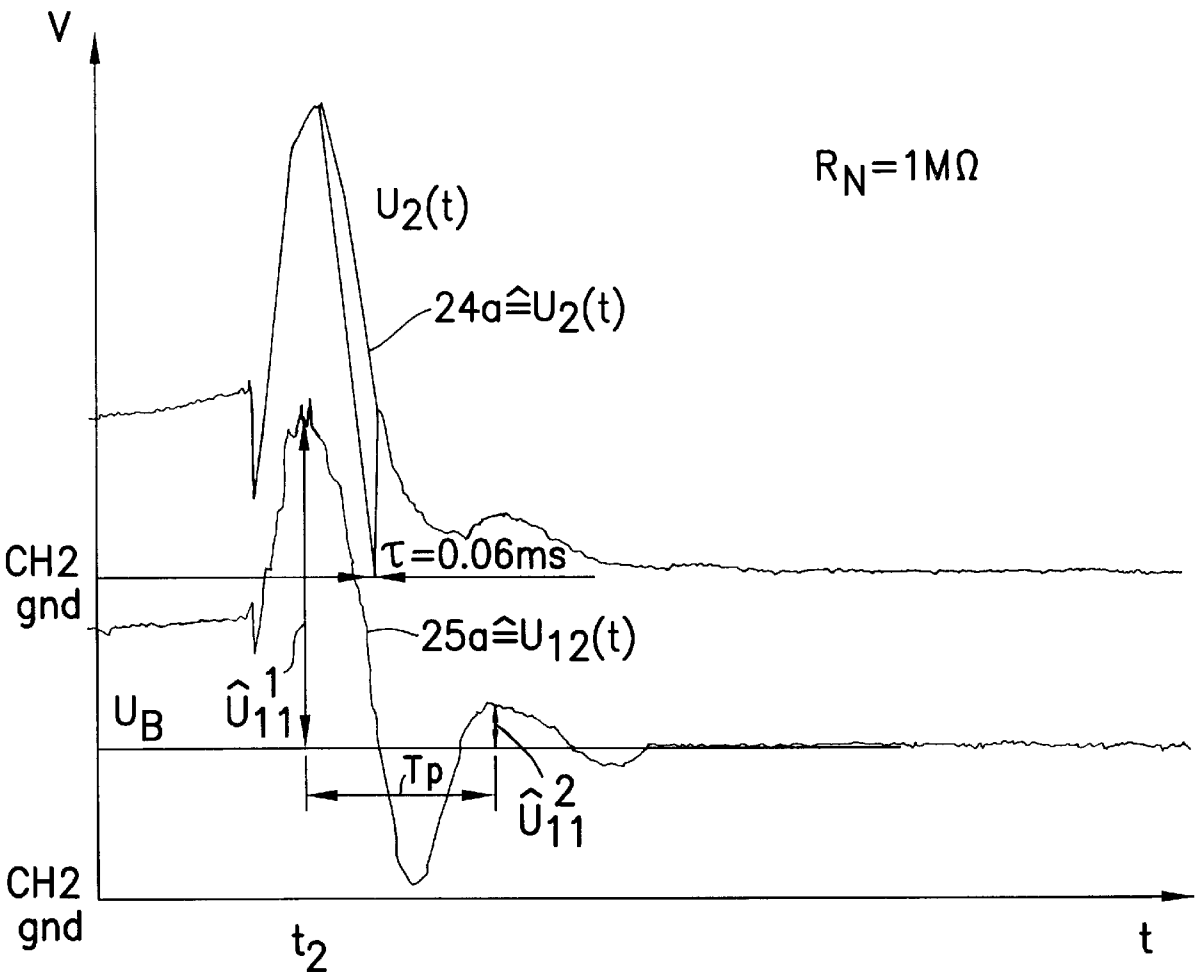
FIG. 3*a* illustrates the dying-out transients of the primary and secondary voltage, given an ignition system with a diode and with a shunt resistance of 1 MΩ.
Figure 3B:
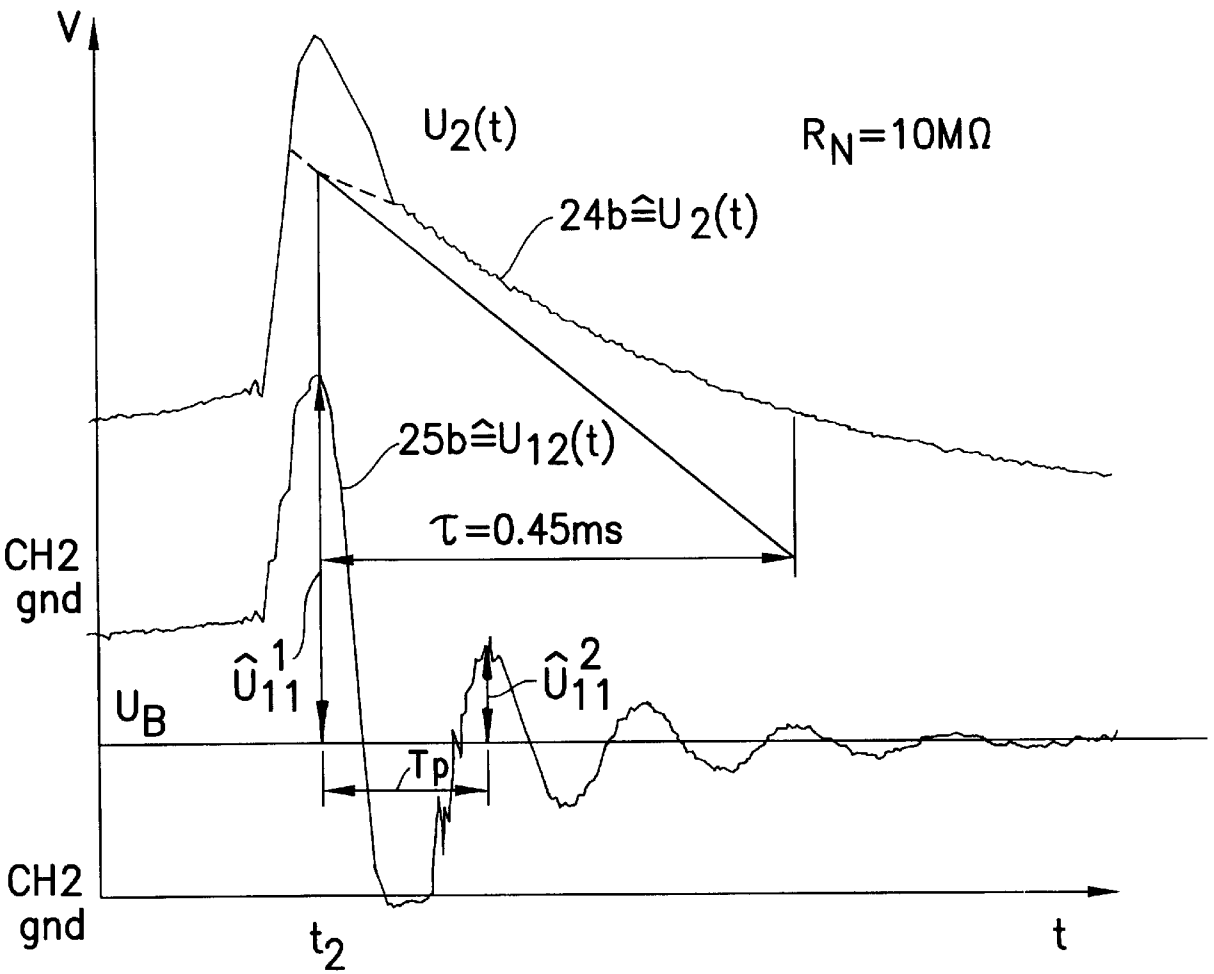
FIG. 3*b* illustrates the dying-out transients of the primary and secondary voltage, given an ignition system with a diode and with a shunt resistance of 10 MΩ.

FIGS. 3*a* and 3*b* show the voltage characteristics of an ignition circuit on the secondary side ($U_{2(t)}$) and on the primary side ($U_{12(t)}$), with a diode for suppressing energizing sparks and with a shunt resistor, the shunt resistance in the voltage characteristics in FIG. 3*a* amounting to 1 MΩ and in FIG. 3*b* to 10 MΩ. The curves 24*a* or 24*b* illustrate the voltage characteristic on the secondary side. It is discernible that in response to a loading of the secondary circuit with a shunt resistance, the damping has a substantially smaller time constant $\tau$. In FIG. 3*a,* the time constant is $\tau$=0.06 ms and in FIG. 3*b* $\tau$=0.45 ms. The curves 25*a* or 25*b* show the voltage characteristic of the secondary voltage transformed to the primary side after the end of sparking $t_2$. When the capacitance of the ignition harness is discharged through a small shunt resistance and when the voltage peaks induced in the secondary winding are greater than the residual voltage, the diode becomes conductive and withdraws energy from the resonant circuit. This is revealed in a curve 25*a* showing increasingly damped oscillation peaks on the primary side. At a shunt resistance of 10 MΩ, apart from the first voltage peak, the primary voltage still has four further voltage maxima. When the shunt resistance is reduced to 1 MΩ, as in FIG. 3*a,* only one further heavily damped voltage maximum is discernible. The greater the shunt resistance is, the more pronounced the oscillatory characteristic will be.

Figure 4A:
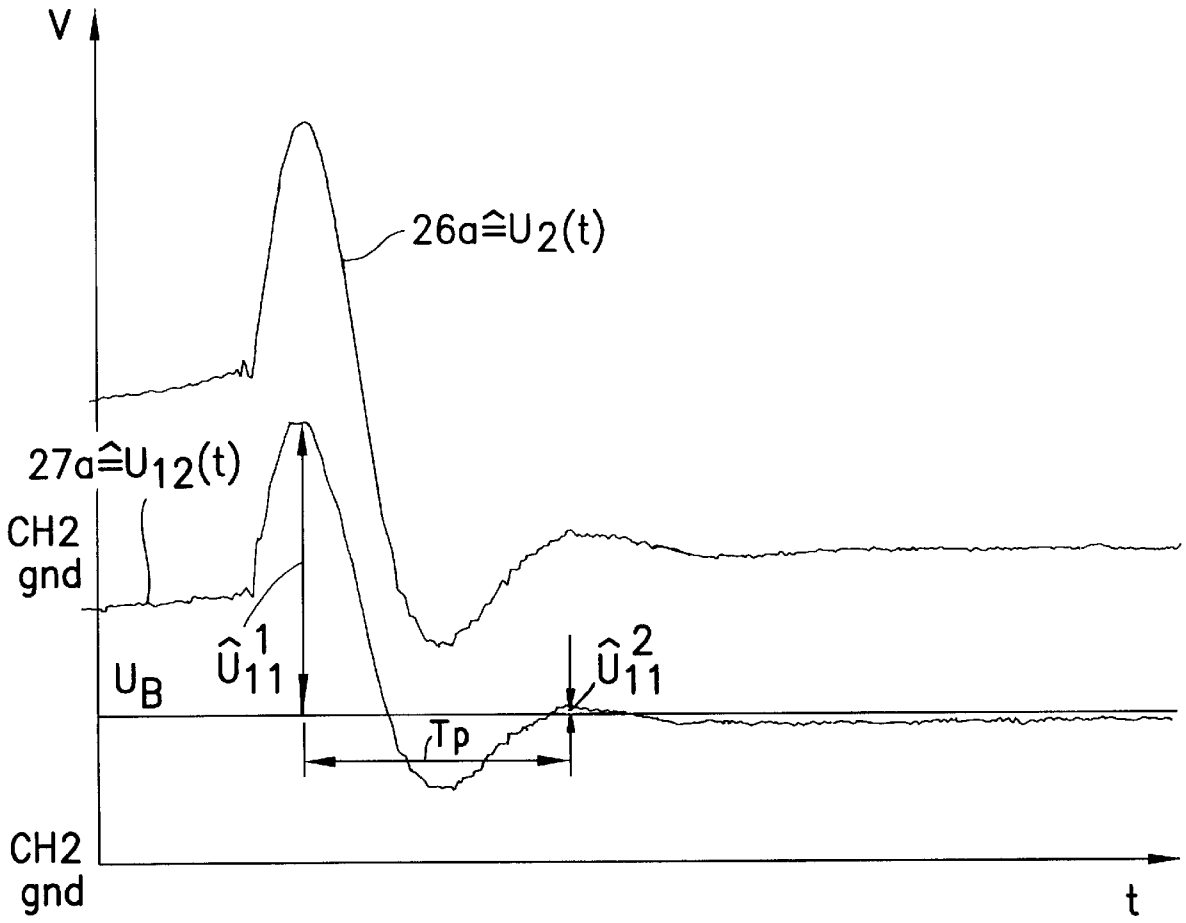
FIG. 4*a* illustrates the dying-out transients of the primary and secondary voltage, given an ignition system without a diode for preventing the energizing spark, and with a shunt resistance of 1 MΩ.
Figure 4B:
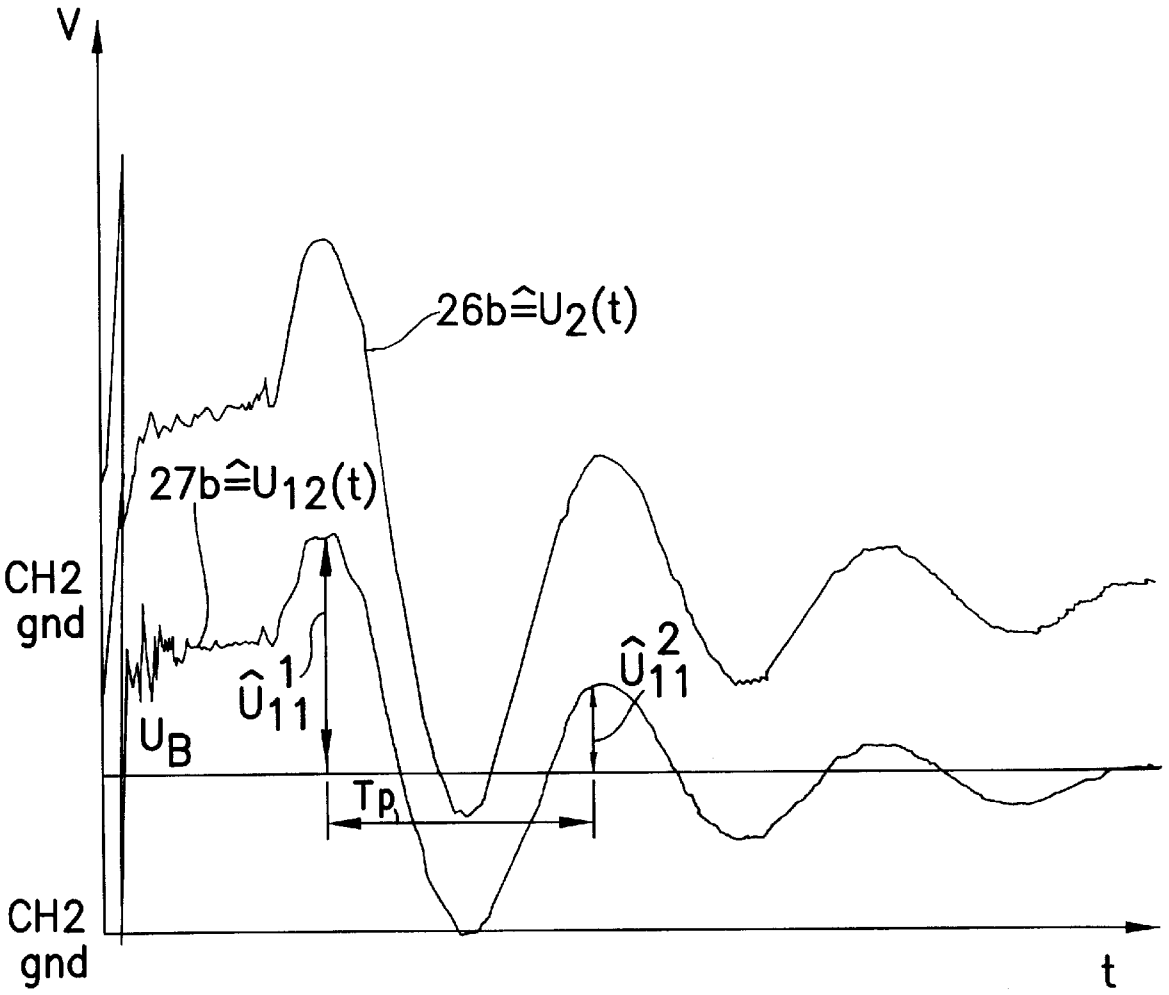
FIG. 4*b* illustrates the dying-out transients of the primary and secondary voltage of an ignition system without a diode for preventing the energizing spark, and with a shunt resistance of 10 MΩ.

FIGS. 4*a* and 4*b* likewise show the voltage characteristics in the ignition system in accordance wit: FIG. 1, however, without the diode 18 for suppressing energizing sparks, the shunt resistance amounting in the measurements of FIG. 4*a* to 1 MΩ and in the measurements of FIG. 4*b* to 10 MΩ. In the circuit arrangement in accordance with FIG. 1 that does not include suppression of energizing sparks, the isolation of the secondary circuit is omitted outside of the ignition coil. At a shunt resistance of 10 MΩ, as in FIG. 4*b,* the oscillations of the primary and secondary voltage are similar. The curve 26*b* of FIG. 4*b* shows the secondary voltage characteristic $U_{2(t)}$ at 10 MΩ shunt resistance, and curve 27*b* shows the voltage characteristic $U_{12(t)}$ transformed to the primary side. FIG. 4*a* shows the measuring curves 26*a* and 27*a,* given a shunt resistance of 1 MΩ, and reveals that both voltages are mutually damped.

The theoretical basis for evaluating the secondary voltage detected on the primary side after the end of sparking $t_2$ is revealed as follows. A model for the characteristic of the primary voltage is:

$$u_{1x}(t) = \hat{u}_{1x} \cdot e^{\frac{-t}{\tau_p \cdot cos(\omega t)}}$$

$\tau_p$—time constant $\omega$—natural frequency $u_{1x}$—synonymous with $u_{11}$ or $u_{12}$ This formula can also be expressed according to the Hilbert transformation as follows:

$$\hat{u}_{1x}(t) = \cdot\, u_{1x}\, e^{\frac{t}{\tau_p \cdot e^{-j\omega t}}}$$

$\hat{u}_{1x}(t)$—analytical voltage signal

Accordingly, the characteristic denoting the damping is the variable $\tau$. Various model-based methods are feasible to precisely determine $\tau$.

Another characteristic for influencing the shunt resistance is defined as the relationship between the second and the first positive voltage peak and is expressed as:

$$q_1 = \frac{\hat{u}_1{}^2x}{\hat{u}_1{}^1x}$$

$\hat{u}_1{}^2$—being the first/second positive voltage peak of $u_{1x}$.

As described further above, structural (pattern) transformation can occur on the secondary side in response to very small shunt resistances, so that the oscillating discharging of the ignition coil enters into an aperiodic oscillation (compare FIG. 2, $U_{2(t)}$). Here, the second maximum of the primary voltage is omitted. An alternative is to produce the peak value $u^2{}_{1x}$ at a fixed interval to the first maximum. This fixed interval $T_p$ is the period duration of the oscillation and is expressed as:

$$q2 = \frac{u1x(t = t\max + T_p)}{u1x(t\max)^{1x}}$$

$t_{max}$—instant of the first maximum $T_p$—period duration.

Figure 5:
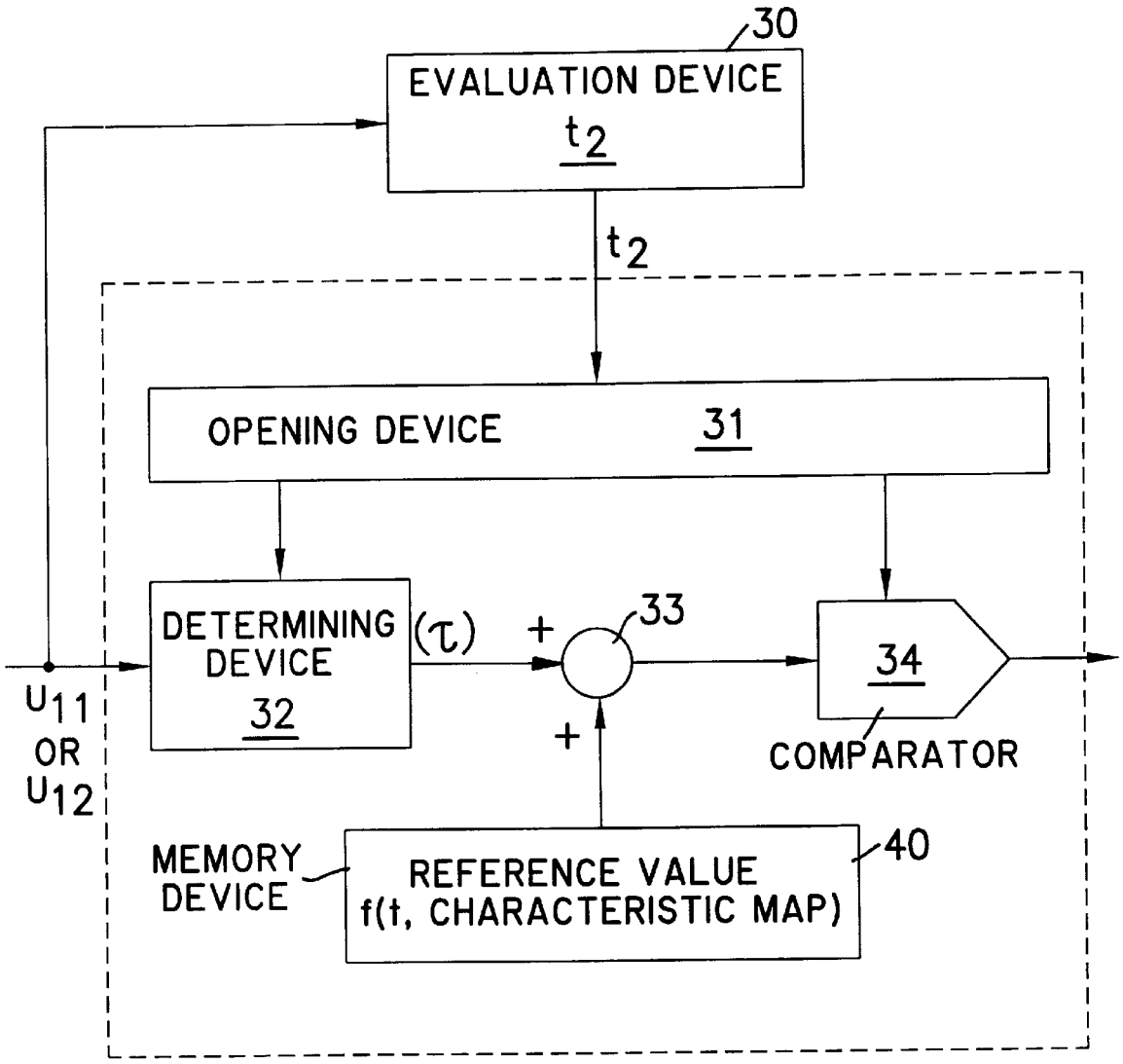
FIG. 5 shows a first exemplary embodiment of an evaluation device for determining the signal attenuation according to the present invention.

FIG. 5 shows a possible configuration of the evaluation unit 16. This evaluation device 16 is supplied with a primary voltage signal $U_{11}$ or $U_{12}$ detected by the means M1 or M2. At the same time, this signal is fed to a device 30, which determines the end of sparking $t_2$ and routes a corresponding trigger signal to the evaluation device 16. A timing window is then opened in the evaluation device 16 by means of the device 31, the attenuation of the signals U11 or U12 within the timing window being determined by the device 32. A measure of the damping is the value $\tau$, which is subsequently combined in a summing element 33 with a constant, characteristics-map-dependent or time-dependent reference value, which is determined, for example, in the application and is stored in a memory device 40. In this case, the constant, characteristics-map-dependent reference value is a negative value, so that the difference between these two values is subsequently evaluated in a comparator 34 and, on this basis, a correction signal is determined for the control unit 14.

Figure 6:
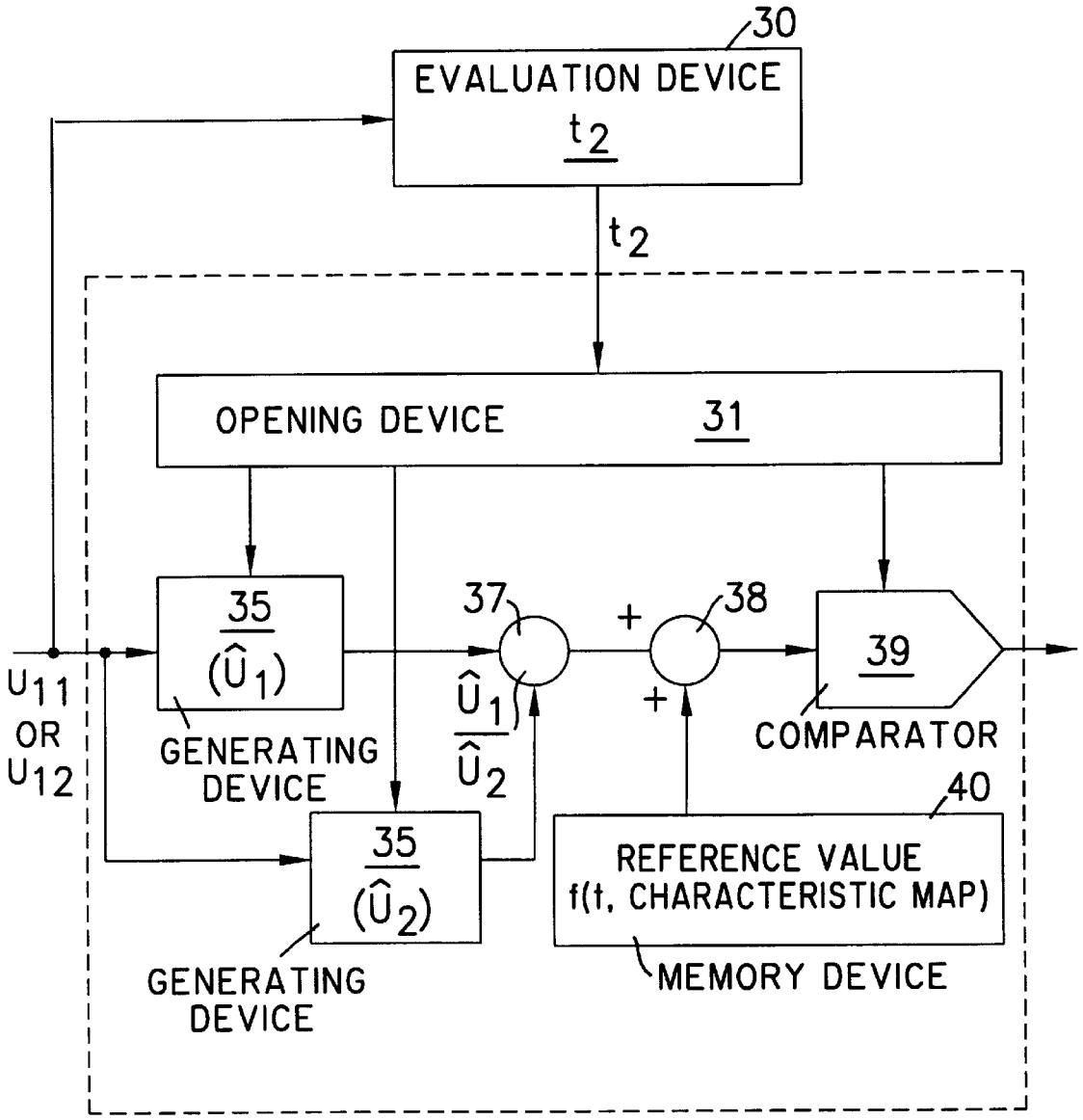
FIG. 6 shows a second exemplary embodiment of an evaluation device for determining the signal attenuation according to the present invention.

FIG. 6 depicts a second possible design of the evaluation device 16. This evaluation unit 16 is supplied with a primary voltage signal $U_{11}$ or $U_{12}$ detected by the means M1 or M2. At the same time, this signal is fed to a device 30, which determines the end of sparking $t_2$ and routes a corresponding trigger signal to the evaluation unit 16. A first timing window is produced in the evaluation device 16 by means of the device 31, a first peak value being generated within the timing window by the device 35. A second timing window is produced in the evaluation device 16 by means of the device 31, a second peak value being generated within the timing window by the device 36. A value which represents a measure of the damping is now calculated in the device 37 by dividing the peak values. This value is compared to a constant, characteristics-map-dependent or time-dependent reference value from the memory 40, and a correction signal for the control unit 14 is determined in the comparator 39.

Figure 7:
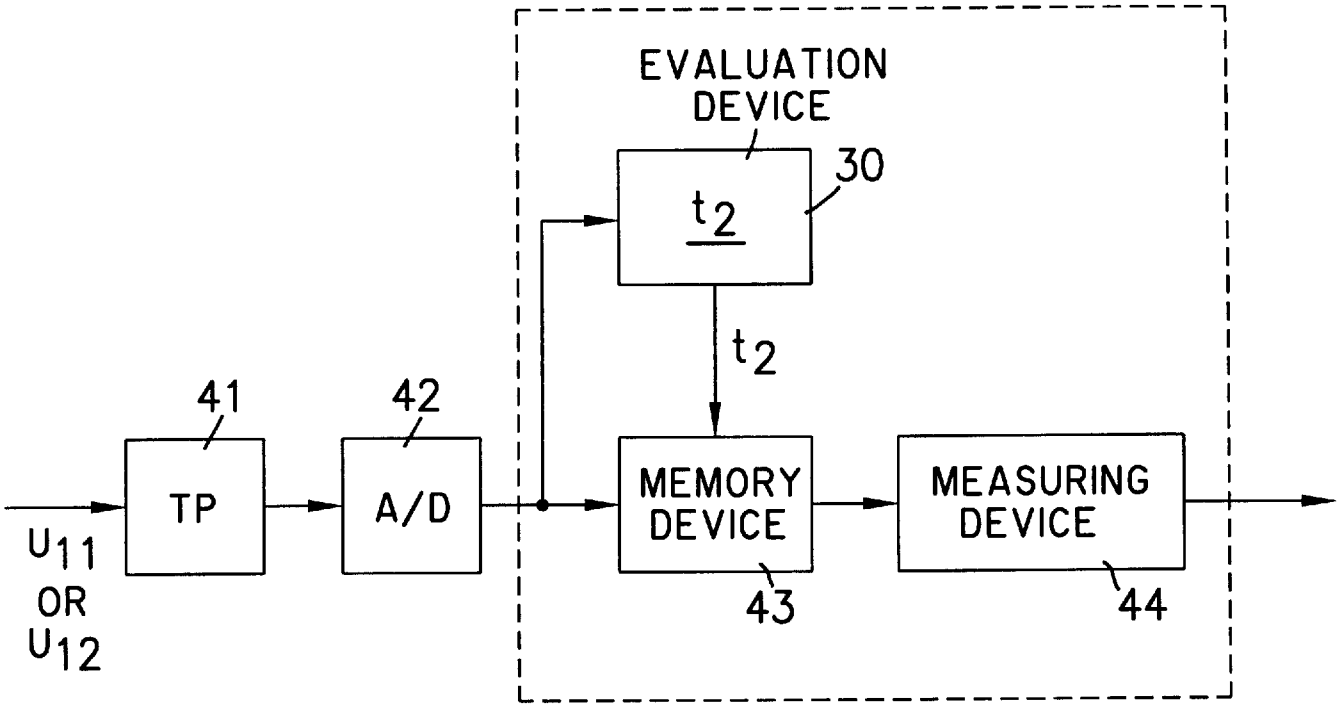
FIG. 7 shows a third exemplary embodiment of an evaluation device for determining the signal attenuation according to the present invention.

FIG. 7 illustrates a third variant of the design of the evaluation device 16 and, in fact, realized as a digital system, e.g., a signal processor. This evaluation device 16 is likewise supplied, as in the FIGS. 5 and 6, with a primary voltage signal detected by the means M1 or M2, however, following a low-pass filtering by means of the low-pass 41 and analog-digital conversion by means of the analog-digital converter 40. The digitized signal is fed to a device 30, which determines the end of sparking and, at the end of sparking, opens a timing window. While the timing window is opened, the digitized signal is stored in a memory 43. A measure of the attenuation of the signals $U_{11}$ or $U_{12}$ is determined in the device 44 from the stored digitized signal. This value is compared to a constant, characteristics-map-dependent or time-dependent reference value, and a correction signal is determined for the control unit 14.

What is claimed is:

1. An ignition system for an internal combustion engine having an ignition coil, comprising:

at least one sensor for detecting operating parameters of the internal combustion engine;

a control unit for determining at least one controlled variable as a function of the operating parameters of the internal combustion engine;

at least one means for detecting a secondary voltage transformed to a primary side of the ignition coil; and an evaluation device for receiving the detected secondary voltage from the means for detecting, the evaluation device determining a damping of the secondary voltage after an end of sparking, the damping being indicative of a functioning of the ignition system, wherein the at least one controlled variable corresponds to the damping.

2. The ignition system according to claim 1, wherein the damping represents a measure for a magnitude of a shunt resistance on a secondary side of the ignition coil.

3. The ignition system according to claim 1, wherein an output of the evaluation device is coupled to the control unit, to define a controlled variable for a following ignition cycle.

4. The ignition system according to claim 1, wherein the evaluation device evaluates the secondary voltage within a measuring window, the measuring window being able to be activated at the end of sparking.

5. The ignition system according to claim 1, wherein a quotient of a first peak value and a second peak value of the secondary voltage is defined after the end of sparking as a measure of the damping.

* * * * *